US006109142A

United States Patent [19]

Learng

[11] Patent Number: 6,109,142

[45] Date of Patent: Aug. 29, 2000

[54] SOCKET

[76] Inventor: Sea Bang Learng, 11F-2, No. 43, Jan-I Street, Taichung City, Taiwan

[21] Appl. No.: 09/344,993

[22] Filed: Jun. 25, 1999

[51] Int. Cl.[7] ..... B25B 13/06

[52] U.S. Cl. ..... 81/124.5; 81/124.6; 81/185; 81/DIG. 11

[58] Field of Search ..... 81/124.5, 124.4, 81/124.6, 125.1, 185, DIG. 11

[56] References Cited

U.S. PATENT DOCUMENTS 5,048,379 9/1991 Gramera et al. ..... 81/124.4
5,148,724 9/1992 Rexford ..... 81/124.4 X
5,157,995 10/1992 Nogues ..... 81/124.5

*Primary Examiner*—D. S. Meislin
*Attorney, Agent, or Firm*—Charles E. Baxley

[57] ABSTRACT

A socket includes two open ends and each open end has a polygonal inner periphery. Three of the sides defining each polygonal inner periphery have a groove defined therein and two springs are received in the two open ends. Each open end has a frame received therein and contacts the spring. Each frame has three protrusions which is received in the grooves and extend radially into the open end. Each frame is retained by a retaining device. A small object can be engaged with the three protrusions in the open end, and a large object can be engaged with the polygonal inner periphery of the open end by pushing the frame and the spring.

6 Claims, 4 Drawing Sheets

SOCKET

FIELD OF THE INVENTION

The present invention relates to a socket, and more particularly, to an improved socket having two open ends and each open end having a spring, a frame and a retaining member to retain the frame in the open end. The frame has a small inner periphery for engaging a small object and a large object is engaged with the inner periphery of the open end.

BACKGROUND OF THE INVENTION

A conventional socket can only engage with an object having a fixed size. If the user chooses a wrong socket which has an incorrect size, a smaller object or a larger object cannot be engaged with the socket. Therefore, the user has to prepare many sockets with different sizes so as to tighten or loosen objects having various sizes. It is understandable that when facing many objects with different sizes, the processes of choosing correct sockets, engaging the sockets with the right objects, and removing the sockets from the objects are time-consuming.

The present invention intends to provide a socket which has two open ends and each open end is able to engage with at least two objects with different sizes so that the user can only carry some sockets with him/her and can handle many situations of tightening or loosening objects. The present invention is able to mitigate the disadvantages of the conventional sockets.

SUMMARY OF THE INVENTION

In accordance with one aspect of the present invention, there is provided a socket comprising a first open end and a second open end. The first open end has a polygonal inner periphery and at least two of the sides defining the polygonal inner periphery each have a groove defined therein. A spring is received in the first open end. A frame is movably received in the first open end and contacts the spring. The frame has at least two protrusions extending laterally from the periphery of the frame and the at least two protrusions are engaged with the least two grooves. The at least two protrusions each have an outside which is engaged with the groove corresponding thereto and an inside which extends radially inward from the polygonal inner periphery of the first open end. A retaining means for retaining the frame is in the first open end.

The object of the present invention is to provide a socket which has two open ends and each open end has a spring, a frame and a retaining means. A small object can be engaged with three protrusions extending from the frame and a large object can be engaged with the polygonal inner periphery of the open end by pushing the frame and the spring.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figures 1, 6:
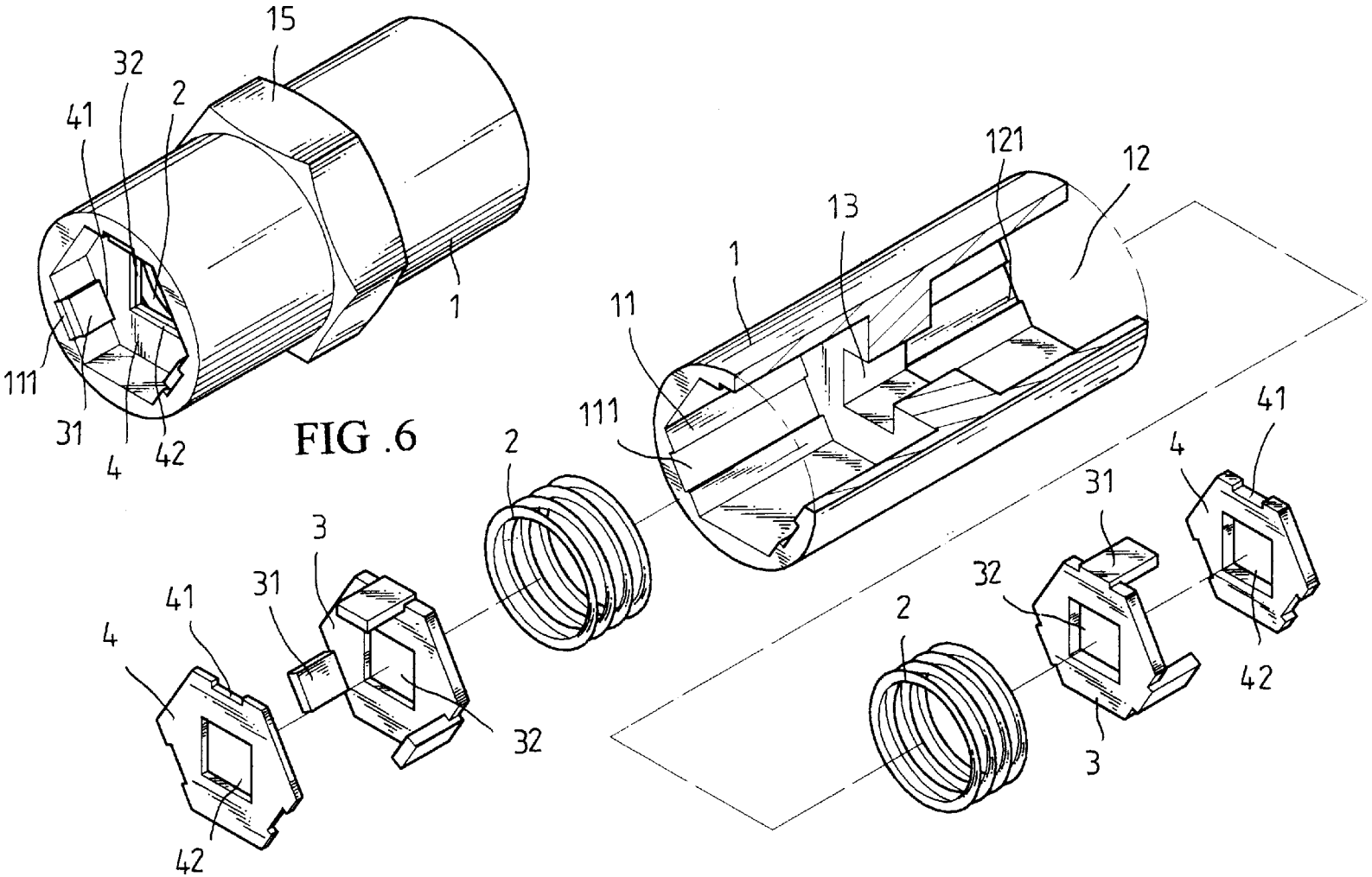
FIG. 1 is an exploded view of the socket in accordance with the present invention.
FIG. 6 is a perspective view of another embodiment of the socket in accordance with the present invention.
Figure 2:
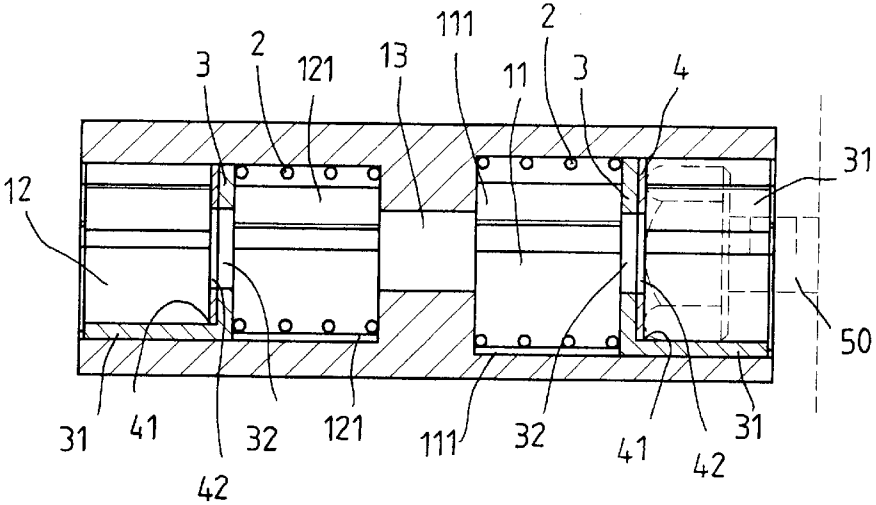
FIG. 2 is a side elevational view, partly in section, of the socket in accordance with the present invention, wherein s small object is engaged with the first open end and a tool is inserted through the first open end and engaged with a square passage.

Referring to FIGS. 1 and 2, the socket 1 of the present invention comprises a first open end 11 and a second open end 12, a connecting portion located in the socket and between the first open end 11 and the second open end 12. Each of the first open end 11 and the second open end 12 has a polygonal inner periphery which is hexagonal inner periphery in this embodiment. Three of the sides defining each hexagonal inner periphery each have a groove 111/121 defined therein. The connect portion has a square passage 13 defined longitudinally therethrough which communicates with the first open end 11 and the second open end 12.

Two springs 2 are respectively received in the first open end 11 and the second open end 12, and respectively contact the connecting portion. Each of the first open end 11 and the second open end 12 has a frame 3 movably received therein so that the two frames 3 contacts the spring 2 corresponding thereto. Each frame 3 has three protrusions 31 extending laterally from the periphery of the frame 3 so that the three protrusions 31 are movably engaged with the grooves 111/121. The protrusions 31 each have an outside which is engaged with the groove 111/121 corresponding thereto and an inside which extends radially inward into the hexagonal inner periphery of the first open end 11 and the second open end 12. Each frame 3 has a square hole 32 defined therethrough.

A retaining means 4 for retaining each frame 3 is a hexagonal plate and has three notches 41 defined in the periphery so that the three protrusions 31 of each frame 3 are engaged with the notches 41 in the first open end 11 and the second open end 12. Each retaining means 4 has a square hole 42 defined therethrough.

Figure 3:
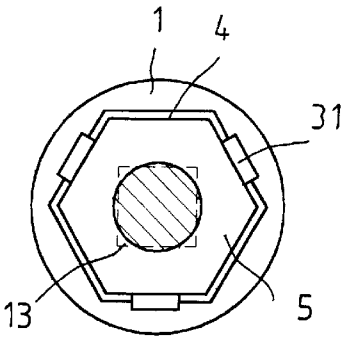
FIG. 3 is a cross-sectional view to show a small object is engaged with three protrusions of the frame.

Referring to FIGS. 2 and 3, a small object 5 can be engaged in the first open end 11 with the three sides of the object 5 engaged with the insides of the three protrusions 31. An L-shaped tool 60 as shown in FIG. 4 is inserted through the second open end 12 and securely engaged with the rectangular passage 13 in the connecting portion so that the object 5 can be tightened or loosened by rotating the tool 60.

Figure 5:
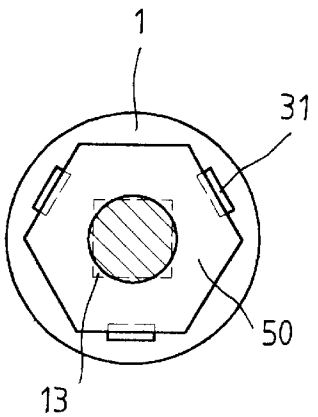
FIG. 5 is a cross-sectional view to show a large object is engaged with the inner polygonal periphery of the first open end.
Figure 4:
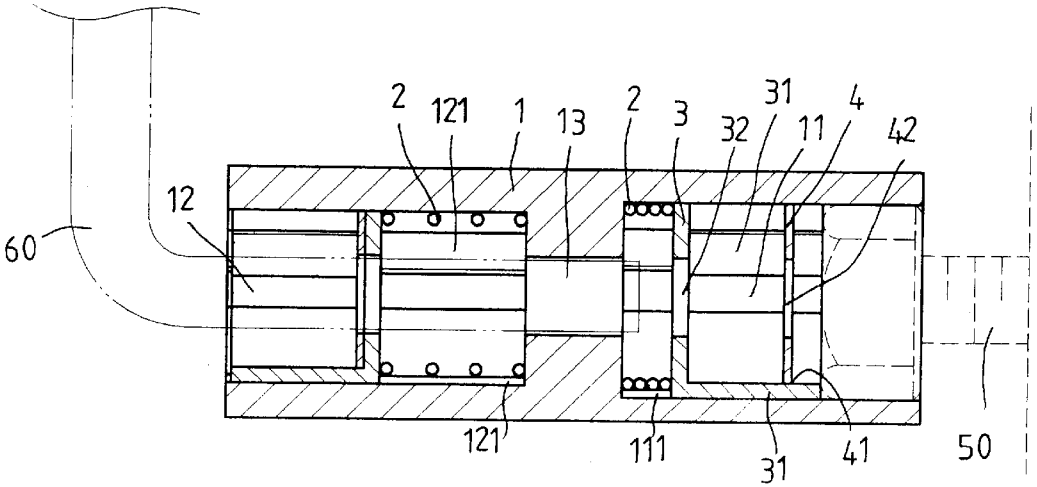
FIG. 4 is a side elevational view, partly in section, of the socket in accordance with the present invention, wherein a large object is engaged with the first open end by pushing the frame and the spring.

Referring to FIGS. 4 and 5, a large object 50 can be engaged with the hexagonal inner periphery in the first open end 11 wherein the object 50 pushes the three protrusions 31 of the frame 3 and compresses the spring 2. The L-shaped tool 60 is inserted through the second open end 12 and securely engaged with the rectangular passage 13 in the connecting portion so that the object 50 can be tightened or loosened by rotating the tool 60. In other words, the first open end 11 of the socket 1 can receive two objects 5, 50 with different sizes. Similarly, the second open end 12 can also receive another two objects with different sizes so that the socket 1 may be engaged with objects having four different sizes.

Referring to FIG. 6, the socket 1 has a polygonal flange 15 extending radially outward from an outside of the socket 1 so that the polygonal flange 15 can be clamped by a wrench (not shown) and the socket 1 can be rotated by the wrench.

Figure 7:
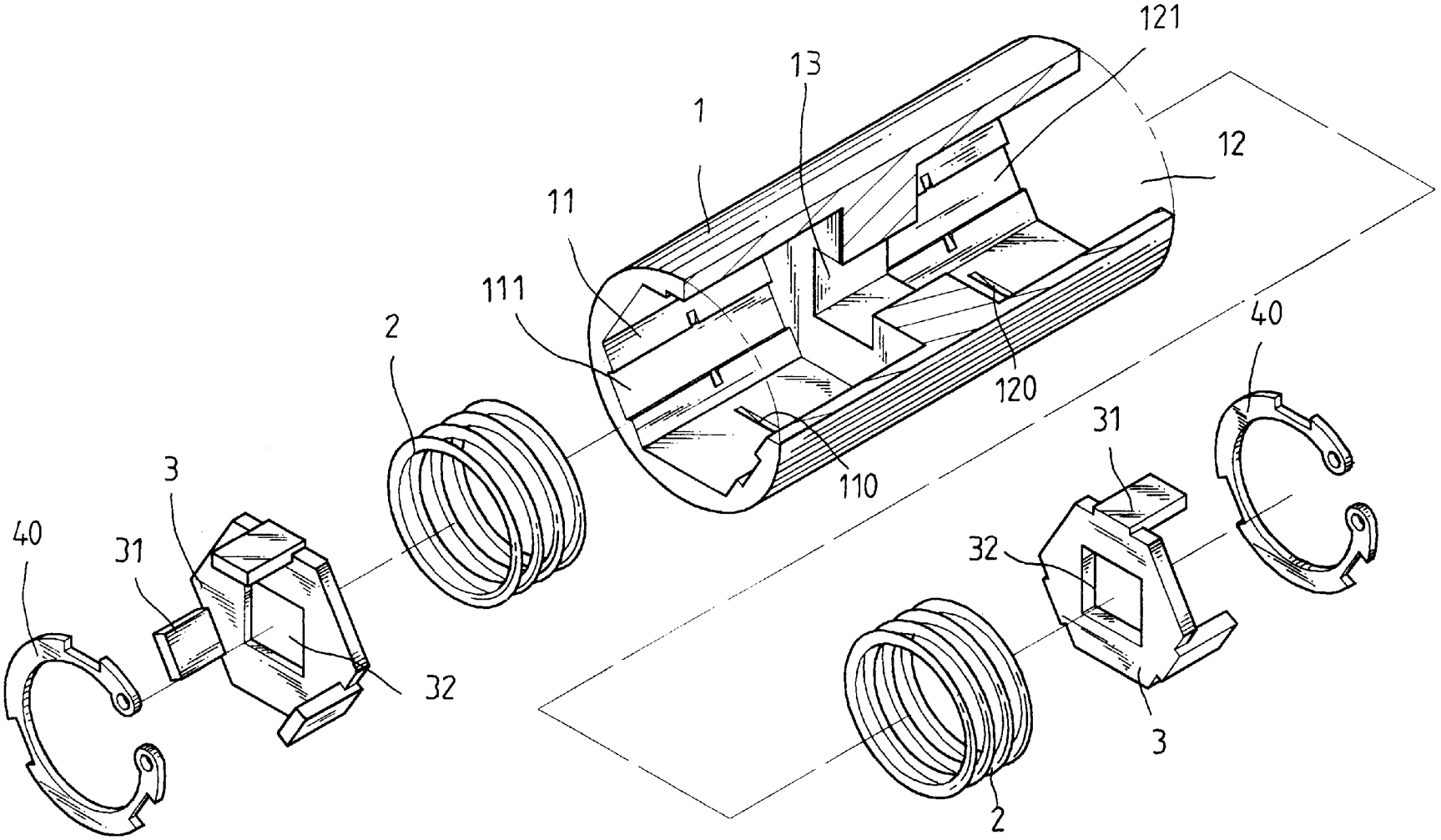
FIG. 7 is an exploded view of yet another embodiment of the socket in accordance with the present invention.

Referring to FIG. 7, the retaining means 4 is a C-shaped clip 40, and the first open end 11 and the second open end 12 each have a plurality of slots 110/120 so that the C-shaped clip 40 is engaged with the slots 110/120.

Figure 8:
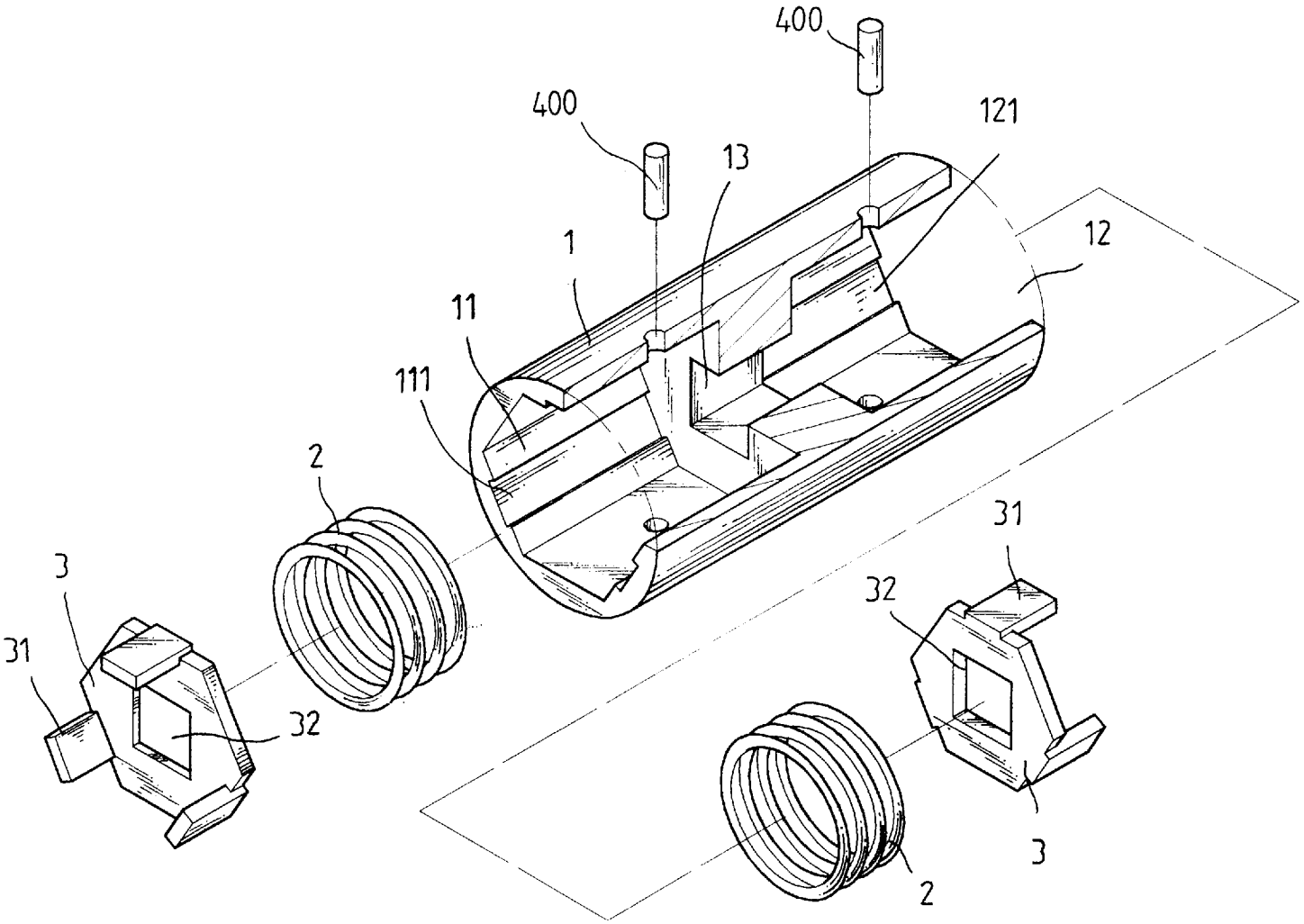
FIG. 8 is an exploded view of still another embodiment of the socket in accordance with the present invention.

Referring to FIG. 8, the retaining means 4 includes two pins 400 which respectively extend radially through the wall of the socket 1 and retain the two frames 3.

While we have shown and described various embodiments in accordance with the present invention, it should be clear to those skilled in the art that further embodiments may be made without departing from the scope and spirit of the present invention.

What is claimed is:

1. A socket comprising:

a first open end and a second open end, a connecting portion located in said socket and between said first open end and said second open end, said first open end having a polygonal inner periphery, at least two of the sides defining said polygonal inner periphery having a groove defined therein;

a spring received in said first open end and contacting said connecting portion;

a frame movably received in said first open end and contacting said spring, said frame having at least two protrusions extending laterally from the periphery of said frame, said at least two protrusions engaged with said least two grooves, said at least two protrusions each having an outside which is engaged with said groove corresponding thereto and an inside which extends radially inward into said polygonal inner periphery of said first open end, and a retaining means for retaining said frame in said first open end.

2. The socket as claimed in claim 1, wherein said retaining means has at least two notches defined in the periphery thereof and said at least two protrusions are engaged with said at least two notches.

3. The socket as claimed in claim 1, wherein said connecting portion has a square passage defined longitudinally therethrough, each of said frame and said retaining means having a square hole defined therethrough.

4. The socket as claimed in claim 1 further comprising a polygonal flange extending radially outward from an outside of said socket.

5. The socket as claimed in claim 1, wherein said retaining means is a C-shaped clip.

6. The socket as claimed in claim 1, wherein said retaining means is a pin which extends radially through said socket and retains said frame.

* * * * *